US006495969B1

(12) United States Patent
Nilssen

(10) Patent No.: US 6,495,969 B1
(45) Date of Patent: Dec. 17, 2002

(54) SERIES-RESONANT BALLAST HAVING OVERLOAD CONTROL

(76) Inventor: Ole K. Nilssen, Caesar Dr., Route #5, Barrington, IL (US) 60010

( * ) Notice: Subject to any disclaimer, the term of this patent is extended or adjusted under 35 U.S.C. 154(b) by 0 days.

(21) Appl. No.: 08/425,256

(22) Filed: Apr. 17, 1995

Related U.S. Application Data

(63) Continuation of application No. 07/280,943, filed on Dec. 7, 1988, which is a continuation-in-part of application No. 07/080,865, filed on Aug. 3, 1987, now Pat. No. 4,819,146.

(51) Int. Cl.[7] ..... H05B 37/02

(52) U.S. Cl. ..... 315/209 R; 315/208; 315/246; 315/219; 315/DIG. 4; 315/DIG. 7

(58) Field of Search ..... 315/DIG. 4, DIG. 7, 315/244, 219, 297, 307, 207, 208, 246, 209 R, 217; 363/98, 132; 331/113 A

(56) References Cited

U.S. PATENT DOCUMENTS 3,238,445 A * 3/1966 Sikorra ..... 363/132
3,263,122 A * 7/1966 Genuit ..... 315/DIG. 7
3,909,668 A * 9/1975 Loakmann et al. ..... 315/209 R
4,127,797 A * 11/1978 Perper ..... 315/209 R
4,170,747 A * 10/1979 Holmes ..... 315/DIG. 7
4,251,752 A * 2/1981 Stolz ..... 315/208
4,277,728 A * 7/1981 Stevens ..... 315/247
4,358,713 A * 11/1982 Senoo et al. ..... 315/169.1
4,370,600 A * 1/1983 Zansky ..... 315/209 R
4,538,095 A * 8/1985 Nilssen ..... 315/DIG. 7
4,553,070 A * 11/1985 Sairanen ..... 331/113 A
4,560,908 A * 12/1985 Stupp et al. ..... 315/219
4,563,719 A * 1/1986 Nilssen ..... 361/45
4,677,345 A * 6/1987 Nilssen ..... 315/DIG. 7
4,682,080 A * 7/1987 Ogawa et al. ..... 315/DIG. 4
4,682,084 A * 7/1987 Kuhnel et al. ..... 315/307
RE32,901 E * 4/1989 Nilssen ..... 315/DIG. 7
4,920,300 A * 4/1990 Scott ..... 315/209 R
4,996,462 A * 2/1991 Krummel ..... 315/DIG. 7
5,103,139 A * 4/1992 Nilssen ..... 315/219
5,130,610 A * 7/1992 Kakitani ..... 315/219
5,164,637 A * 11/1992 Nilssen ..... 315/209 R
5,175,474 A * 12/1992 Kakitani et al. ..... 315/219

FOREIGN PATENT DOCUMENTS

FR 2416619 * 10/1979 ..... 315/DIG. 4

OTHER PUBLICATIONS

IEEE Dictionary of Electrical and Electronics Terms Third Edition 1984 pp. 32 and 465.*

* cited by examiner

*Primary Examiner*—Michael B Shingleton

(57) ABSTRACT

An inverter is powered from a DC voltage whose instantaneous absolute magnitude is equal to that of the AC power line voltage except for being prevented from falling below a level equal to half the peak of the power line voltage. The inverter's output is loaded via a series-tuned high-Q LC circuit. Two fluorescent lamps are loading the secondary winding of a transformer whose primary winding is connected across the capacitor of the LC circuit. The magnitude of the voltage present across the capacitor is normally limited by the loading of the fluorescent lamps. However, with the lamps removed, if not expressly prevented from doing so, the magnitude of the voltage across the capacitor will increase to a destructive level due to Q-multiplication. To prevent this, an auxiliary winding on the transformer is used for limiting the magnitude for the voltage across the capacitor by rectifying the output from the auxiliary winding and feeding the resulting DC to the inverter's input; whereby the magnitude of the voltage across the capacitor will be limited to a level determined by the instantaneous magnitude of the DC voltage; which level is set such as to result in acceptable lamp starting while at the same time preventing any voltage-limiting from taking place at any time as long as the lamps are operating.

13 Claims, 1 Drawing Sheet

SERIES-RESONANT BALLAST HAVING OVERLOAD CONTROL

RELATED APLICATION

This is a continuation of Ser. No. 07/280,943 filed Dec. 7, 1988 which is Continuation-in-Part of Ser. No. 07/080,865 filed Aug. 3, 1987, now U.S. Pat. No. 4,819,146.

BACKGROUND OF THE INVENTION

1. Field of the Invention

The present invention relates to series-resonant-loaded inverters, particularly as used for powering gas discharge lamps.

2. Description of Prior Art

In an inverter where a gas discharge lamp load is parallel-connected across the tank capacitor of a high-Q LC circuit that is resonantly series-excited by a high-frequency voltage output of the inverter, it is necessary to provide some means to protect against the high currents and voltages resulting due to so-called Q-multiplication whenever the lamp load is removed or otherwise fails to constitute a proper load for the LC circuit.

In U.S. Pat. No. 4,370,600 to Zansky, circuit protection is provided by way of providing to the LC circuit an alternative load in the form of a voltage-clamping means; which voltage-clamping means acts to load the LC circuit during any period when the lamp does not constitute a proper load therefor.

The voltage-clamping is accomplished by rectifying the Q-multiplied voltage output of the LC circuit and by applying the resulting DC output to the inverter's DC power source.

However, during any period when voltage-clamping does occur, a relatively large amount of power circulates within the electronic ballast means: from the inverter's output, through the LC circuit, and back into the inverter's DC power source by way of the voltage-clamping means.

SUMMARY OF THE INVENTION

Objects of the Invention

An object of the present invention is that of providing overload-protection means in a tuned inverter.

This as well as other objects, features and advantages of the present invention will become apparent from the following description and claims.

Brief Description

AC power line voltage is rectified and filtered such as to result in a DC voltage whose instantaneous absolute magnitude is equal to that of the power line voltage except for being prevented from ever falling below about half of the peak magnitude of the power line voltage. A half-bridge inverter is powered from this highly rippled DC voltage. The inverter's output voltage is loaded by way of a series-tuned high-Q LC circuit. Two fluorescent lamps are series-connected across the secondary winding of a transformer whose primary winding is connected across the tank capacitor of the LC circuit.

The magnitude of the voltage present across the tank capacitor is normally limited by the loading represented by the fluorescent lamps. However, with the lamps removed, if not expressly prevented from doing so, the magnitude of the voltage across the tank capacitor will increase to a destructive level due to Q-multiplication. To prevent this from happening, an auxiliary winding on the transformer is used for limiting the magnitude of the voltage across the tank capacitor by rectifying the output from the auxiliary winding and feeding the resulting DC to the inverter's DC input. As a result, the magnitude of the voltage across the tank capacitor will be limited to a level determined by the instantaneous magnitude of the DC voltage; which level is set such as to result in acceptable lamp starting while at the same time preventing any voltage-limiting from taking place at any time when the lamps are indeed operating.

To limit internal power dissipation during periods when the lamps are not connected, the effective magnitude of the inverter's output voltage is made to decrease in a time-delayed manner as a function of the magnitude of the current flowing from the auxiliary secondary winding.

The inverter is of the self-oscillating type and control of the effective magnitude of the inverter's output voltage is effected by controllably heating the ferrite material of one of two saturable current transformers used in the feedback loop.

DESCRIPTION OF THE PREFERRED EMBODIMENT

Details of Construction

Figure 1:
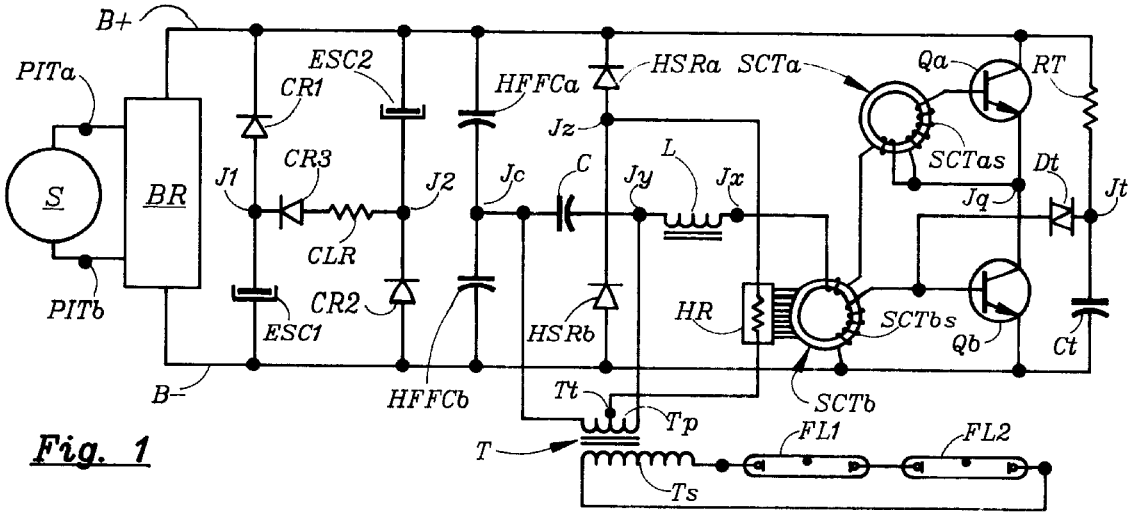
FIG. 1 provides a basic electrical circuit diagram of the preferred embodiment of the invention.

FIG. 1 schematically illustrates the electrical circuit arrangement of the preferred embodiment of the present invention.

In FIG. 1, a source S of ordinary 120 Volt/60 Hz power line voltage is applied to power input terminals PITa and PITb; which terminals, in turn, are connected with a bridge rectifier BR. The DC output from bridge rectifier BR is applied to a B+ bus and a B− bus, with the B+ bus being of positive polarity.

A first communitating rectifier CR1 is connected with its cathode to the B+ bus and with its anode to a junction J1. A first energy-storing capacitor ESC1 is connected between junction J1 and the B− bus. A second communitating rectifier CR2 is connected with its cathode to a junction J2 and with its anode to the B− bus. A second energy-storing capacitor ESC2 is connected between junction J2 and the B+ bus. A third commutating rectifier CR3 is series-connected with a current-limiting resistor CLR to form a series-combination; which series-combination is connected between junctions J1 and J2 in such manner that the cathode of rectifier CR3 is connected with junction J1.

A first high-frequency filter capacitor HFFCa is connected between the B+ bus and a junction Jc; and a second high-frequency filter capacitor HFFCb is connected between junction Jc and the B− bus.

A first switching transistor Qa is connected with its collector to the B+ bus and with its emitter to a junction Jq; a second switching transistor Qb is connected with its collector to junction Jq and with its emitter to the B− bus.

A first saturable current transformer SCTa has a secondary winding SCTas connected across the base-emitter junction of transistor Qa; a second saturable current transformer SCTb has a secondary winding SCTbs connected across the base-emitter junction of transistor Qb. The saturable current transformers each has a primary winding; which primary windings are series-connected between a junction Jx and junction Jq.

A resistor Rt is connected between the B+ bus and a junction Jt; a capacitor Ct is connected between junction Jt and the B− bus; and a Diac Dt is connected between junction Jt and the base of transistor Qb.

A tank inductor L is connected between a junction Jy and junction Jx; and a tank capacitor C is connected between junctions Jy and Jc.

The primary winding Tp of a transformer T is connected between junctions Jc and Jy; while two fluorescent lamps FL1 and FL2 are series-connected across its secondary winding Ts. A tap Tt on primary winding Tp is connected, by way of a heating resistor HR, to a junction Jz; which heating resistor HR is thermally coupled with the magnetic core of saturable current transformer SCTb. A first high-speed rectifier HSRa is connected with its anode to junction Jz and with its cathode to the B+ bus. A second high-speed rectifier HSRb is connected with its cathode to junction Jz and with its anode to the B− bus.

Details of Operation

Except for effects associated with heating the ferrite core of saturable current transformer SCTb, the operation of the half-bridge inverter of FIG. 1 is conventional and is explained in conjunction with FIG. 8 of U.S. Pat. No. Re. 31,758 to Nilssen.

For a given magnitude of the DC supply voltage, due to the effect of the high-Q LC circuit, the magnitude of the current provided to the fluorescent lamp load (or to any other load presented to the output) is a sensitive function of the waveshape of the inverter's output voltage; which output voltage is a squarewave voltage of controllable symmetry and having peak-to-peak magnitude about equal to that of the instantaneous magnitude of the DC voltage present between the B− bus and the B+ bus.

The symmetry of the inverter's squarewave output voltage is a sensitive function of the magnetic flux saturation characteristics of the magnetic core of saturable current transformer SCTb; which flux saturation characteristics determine the duration of the ON-time of transistor Qb.

For a situation where the ferrite cores of both saturable current transformers are heated, the result is increasing inverter frequency with increasing core temperature; which situation is explained in detail in U.S. Pat. No. 4,513,364 to Nilssen. Specifically, as the saturation flux density of the two saturable current transformers is reduced, the inverter's oscillation frequency increases.

One way of reducing the transformers' saturation flux density is that of increasing the temperature of the ferrite magnetic cores used in those transformers; which effect is further explained in U.S. Pat. No. 4,513,364 to Nilssen. However, in instant situation, only one of the two magnetic cores is heated; and the net result is that the duration of the ON-time of transistor Qa stays constant while the duration of the ON-time of transistor Qb decreases.

On the other hand, the fundamental frequency of the inverter's output voltage is determined by the duration of the ON-time of the transistor that has the longest ON-time. Thus, for the circuit arrangement of FIG. 1, as long as the saturation flux of the ferrite core of saturable current transformer SCTa remains unaffected, the inverter's oscillation frequency stays approximately constant even as the saturation flux of the ferrite core of saturable current transformer is reduced. As an overall result, as the duration of the ON-time of transistor Qb is reduced (such as by heating the ferrite core of saturable current transformer SCTb), the fundamental frequency as well as the peak-to-peak magnitude of the inverter's squarewave output voltage remains approximately constant, but the symmetry of this output voltage is modified such as to reduce the magnitude of the fundamental frequency component thereof.

In fact, by sufficiently heating the ferrite core of saturable current transformer SCTb, the duration of the ON-time of transistor Qb may be reduced to near zero, thereby resulting in a dramatic reduction of the magnitude of the fundamental frequency component of the inverter's squarewave output voltage.

Thus, in view of FIG. 1, it is clear that: i) the more heating power provided to heating resistor HR, ii) the higher be the resulting temperature of the magnetic core of saturable current transformer SCTb, iii) the more reduction there-be in the saturation flux density of this current transformers' ferrite magnetic core, iv) the shorter be the duration of the ON-time of transistor Qb, v) the lower be the magnitude of the fundamental frequency component of the inverter's output voltage, and vi) due to the frequency-dependence of the output circuit, the lower be the magnitude of the current provided to the load.

In other words, since the heating power for heating resistor HR is provided by the clamping-current flowing out of tap Tt—as long as the heating resistor is an ordinary linear resistor means—the amount of heating power provided will be determined by the square of the magnitude of the clamping-current; which implies that the magnitude of the fundamental frequency component of the inverter's squarewave output voltage will decrease sensitively as a function of increasing magnitude of the clamping-current. Thus, a negative feedback condition exists: in the end, the magnitude of the clamping-current is manifestly prevented from exceeding the level at which the temperature of the magnetic cores of the saturable current transformers reaches the Curie-point; at which point the inverter ceases to oscillate.

In particular, the various component values were so chosen that the magnitude of the clamping-current stabilized at a level at which the amount of power associated with the clamping function is quite modest; which level is very much lower than the level of power associated with the clamping function prior to heating the magnetic core.

In the circuit of FIG. 1, the LC circuit is normally loaded with the two fluorescent lamps (via transformer T); and when the LC circuit is so loaded, the magnitude of the voltage present across the tank capacitor will be too low to cause clamping-current to flow. However, with the lamp loading removed, due to Q-multiplication, the magnitude of the voltage across the tank capacitor will rise until clamping-current flows.

Figure 2:
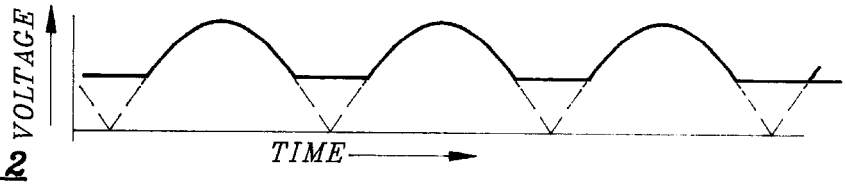
FIG. 2 indicates the waveshape of the DC voltage used for powering the inverter.

With 120 Volt/60 Hz provided to rectifier BR, as indicated by FIG. 2, the magnitude of the DC voltage provided to the inverter varies periodically—at a frequency of 120 Hz—by a factor of about two: from a minimum of about 84 Volt to a maximum of about 168 Volt.

It is important that no clamping occur during normal operation of the fluorescent lamps. During such normal operation, the magnitude of the voltage present across the lamps will be essentially constant: determined by basic lamp characteristics. However, as indicated, the magnitude of the DC voltage is highly variable; which implies that the voltage magnitude at which clamping starts must be at least twice as high as the normal lamp operating voltage.

In fact, taking into account variability in the magnitudes of the power line voltage and the lamps' operating voltage, it is prudent to arrange for a situation where clamping does not start to occur until the magnitude of the voltage across the tank capacitor reaches a level that is about three times as high as the level associated with normal lamp operation.

Figure 3:
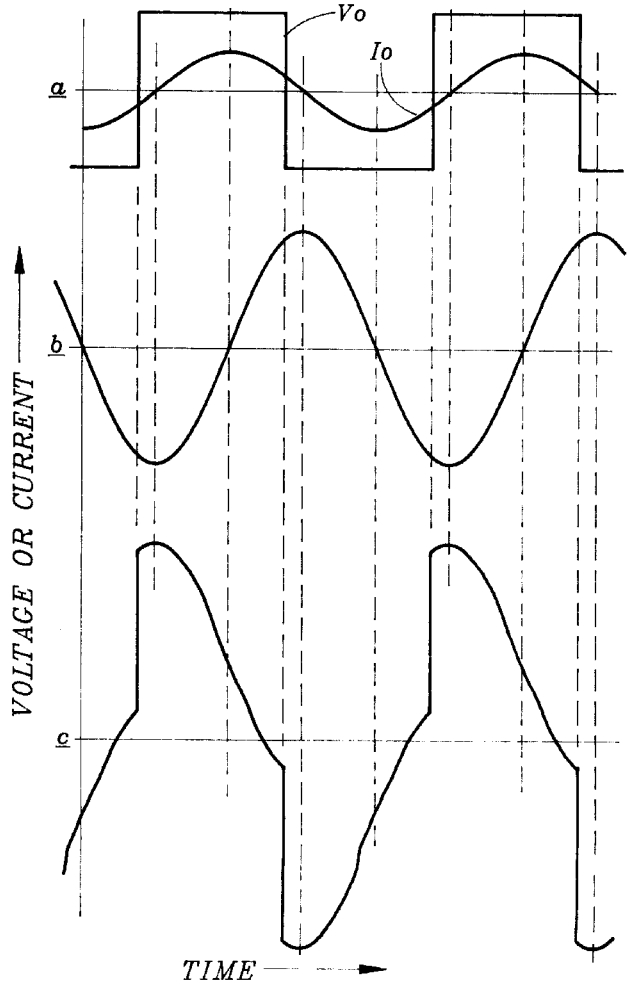
FIG. 3 indicates the waveshape of various high frequency voltages present within the circuit.

With no heating of the ferrite core of saturable current transformer SCTb, the inverter's output voltage will be as indicated by Vo of FIG. 3. The corresponding inverter output current will be as indicated by IO of FIG. 3. The voltage across tank capacitor C will be as indicated in FIG. 3; and the voltage across tank inductor L will be as indicated in FIG. 3.

With heating provided to the ferrite core of saturable current transformer SCTb, the inverter's output voltage Vo will become non-symmetrical; although the inverter frequency will remain substantially constant. As a result, with other things being approximately equal, the magnitude of the inverter's output current will decrease.

When operating normally, the fluorescent lamp load will draw about 60 Watts from the inverter and limit the magnitude of the output voltage across the secondary winding Ts to about 200 Volt. If the lamp load were to be disconnected, the magnitude of the output voltage would increase from about 200 Volt to about 600 Volt, at which point it would be prevented from increasing further due to the clamping effect resulting from the clamping-current flowing from tap Tt of primary winding Tp of transformer T. With other things being approximately equal, with the magnitude of the load voltage effectively increasing by a factor of three, the power drawn from the inverter will likewise increase by a factor of three: from 60 Watts to about 180 Watts; which 180 Watts would circulate: from the inverter's DC source, through the inverter, through the tuned LC circuit, through primary winding Tp, through heating resistor HR, and finally back to the inverter's DC source.

Of course, this circulating power must not damage the inverter nor any other other parts of the circuit. Moreover, since it is indeed possible that the lamp load be left disconnected for extended periods of time, it is important that an excessive amount of power not be dissipated as a result of this continuous circulation of a relatively large amount of power. Thus, absent means for reducing the amount of circulating power, it becomes necessary to use component parts capable continuously and efficiently of handling about three times more power than required under normal conditions where the lamp is indeed connected and operative to constitute a proper loading for the tuned LC circuit.

An important feature of instant invention relates to means for reducing the amount of power circulating when the tuned LC circuit is left externally unloaded. This feature is attained by feeding the clamping-current through heating resistor HR, thereby increasing the temperature of the ferrite core of saturable current transformer SCTb. In turn, this increased temperature significantly reduces the amount of circulating power, thereby reducing dissipation and component stresses.

The control sensitivity is arranged so as to cause the ferrite core of saturable current transformer SCTb to reach its Curie-point at a level of clamping-current that is just slightly higher than the maximum desired level of clamping-current. As a result, if the tuned LC circuit were in fact to be left externally unloaded for some extended period of time, the magnitude of the clamping-current would gradually reduce to but a small fraction of the level it would assume in the absence of controlling the temperature of the ferrite core.

In particular, with the gain in the negative feedback loop set such as to limit the magnitude of the clamping current to 50 milli-Ampere or so, the circulating power is limited to about 30 Watts. That is, the amount of power fed back to the DC source from tap Tt of transformer T is only about 30 Watts.

Of course, as soon as a functioning fluorescent lamp load is connected across secondary winding Ts, the magnitude of the voltage thereacross will fall to about 200 Volt, and clamping current will cease to flow.

Additional Comments a) Detailed information relative to a fluorescent lamp ballast wherein the fluorescent lamp is powered by way of a series-excited parallel-loaded L-C resonant circuit is provided in U.S. Pat. No. 4,554,487 to Nilssen.

One effect of such a ballasting arrangement is that of making the waveshape of the voltage provided across the output to the fluorescent lamps very nearly sinusoidal, even though the output from the inverter itself, at the input to the series-resonant LC circuit, is more-or-less a squarewave.

b) The instantaneous peak-to-peak magnitude of the more-or-less squarewave output voltage provided by the half-bridge inverter between junctions Jq and Jc is substantially equal to the instantaneous magnitude of the DC supply voltage. Thus, as the magnitude of the DC supply voltage varies, so does the peak-to-peak magnitude of the more-or-less squarewave output voltage.

c) During a substantial part of each half-cycle of the 120 Volt/60 Hz power line input voltage, the instantaneous absolute magnitude of the DC supply voltage is substantially equal to that of the power line input voltage.

d) Saturable current transformers SCTa and SCTb require only a miniscule amount of voltage across their primary windings. Hence, the magnitude of the voltage-drop between junctions Jq and Jx is substantially negligible, and the inverter's full output voltage is therefore effectively provided between junctions Jx and Jc.

e) In the arrangement of FIG. 1, voltage-clamping is effectively accomplished by parallel-loading the tank capacitor, as opposed to parallel-loading the tank inductor.

That is, the voltage-clamping is accomplished at a point where the available current is manifestly magnitude-limited—at the fundamental inverter frequency as well as at all harmonics thereof. As a result, no problems exist with respect to component stresses due to peak currents of excessive magnitudes resulting from the clamping process.

The voltage across the tank inductor is substantially non-magnitude-limited with respect to currents at the various harmonics of the inverter frequency. That is, there is no manifest magnitude-limitation on the currents that will flow in the voltage-clamping means when that voltage-clamping means is effectively connected across the tank inductor; and the resulting component stresses are apt to be excessive.

While the voltage across the tank capacitor is apt to be essentially void of harmonics of the inverter frequency (see FIG. 3), the voltage across the tank inductor (see FIG. 3) is particularly rich in harmonics of the inverter frequency. In fact, the voltage across the tank inductor is effectively equal to the (vector) sum of the voltage across the capacitor and the (more-or-less squarewave) voltage provided from the inverter's output.

In the circuit arrangement of FIG. 4 in U.S. Pat. No. 4,370,600 to Zansky, voltage-clamping is applied to the voltage present across the tank inductor; and, as a result, severe component stresses occur as a result of clamping a non-current-limited voltage.

f) The fundamental oscillating frequency of the inverter of FIG. 1 is approximately 30 kHz. During normal operation—that is, when fully loaded with its lamp load—the inverter's output voltage is a symmetrical squarewave, as indicated by Vo of FIG. 3*a*; and the ON-time of each of the two switching transistors has a duration of about 16 micro-seconds.

As the temperature of the ferrite core of saturable current transformer SCTb is gradually increased, the duration of the ON-time of transistor Qb gradually decreases—while the duration of the ON-time of transistor Qa remains substantially constant. As a result, the inverter's output voltage becomes non-symmetrical. Ultimately, the inverter's output voltage will become brief negative (square) voltage pulses alternating with relatively long positive (square) voltage pulses. As a result, the magnitude of the fundamental frequency component of the inverter's output voltage decreases when increasing the temperature of the ferrite core of saturable current transformer SCTb.

g) As may be observed by comparing waveforms Io and Vo of FIG. 3, the current flowing from the inverter's output is somewhat delayed compared with the squarewave output voltage; which is to say that the inverter's loading is slightly inductive at the squarewave fundamental frequency.

That is, forward conduction of each switching transistor stops before the forward current has reached zero magnitude. As a result, at the point of switching, the current that was forward-flowing in one transistor will—as soon as that transistor ceases to conduct—continue to flow as reverse current in the other transistor. In this other transistor, this reverse current will flow from the emitter, through the (saturated) secondary winding of the associated current transformer, and through the base-collector junction.

Thus, in a situation where saturable current transformer SCTb has a relatively high temperature and the ON-time of transistor Qb is relatively short, the inverter's more-or-less sinusoidal output current will most of the time flow through transistor Qa: either in the forward direction, or in the reverse direction via secondary winding SCTas and the base-collector junction.

h) Controlling the inverter's output by way of controlling the symmetry of its squarewave output voltage has an advantage compared with controlling its output by way of controlling the inverter's frequency.

The inverter's frequency can be controlled by heating the ferrite cores of both saturable current transformers. However, as frequency increases, the resulting output current will become more-and-more out of phase with the inverter's output voltage; which implies that each transistor will switch at a point where the magnitude of the forward-flowing current is relatively large; which, in turn, leads to high switching losses.

On the other hand, by heating only one of the ferrite cores, transistor switching occurs at a more favorable point—particularly in the situation of minimum power output.

i) It is believed that the present invention and its several attendant advantages and features will be understood from the preceding description. However, without departing from the spirit of the invention, changes may be made in its form and in the construction and interrelationships of its component parts, the form herein presented merely representing the presently preferred embodiment.

What is claimed is:

1. A combination comprising:

a source of AC power line voltage;

a rectifier circuit connected with the AC power line voltage and operative to provide a DC voltage at a DC output; the instantaneous absolute magnitude of the DC voltage being: (i) substantially equal to that of the AC power line voltage whenever the instantaneous absolute magnitude of the AC power line voltage is higher than about half its peak absolute magnitude; and (ii) approximately constant whenever the instantaneous absolute magnitude of the AC power line voltage is lower than about half its peak absolute magnitude;

an inverter circuit connected with the DC output and operative to provide an inverter output voltage at a set of inverter terminals; and a load circuit connected with the inverter terminals; the load circuit including an LC circuit effectively series-connected across the inverter terminals; the LC circuit having a tank capacitor and a tank inductor; a pair of output terminals being effectively parallel-connected with the tank capacitor; the LC circuit being resonant at or near the fundamental frequency of the inverter output voltage; an output voltage developing across the output terminals; the magnitude of the output voltage being determined by the nature of a final load connected in circuit therewith; the final load comprising an effective parallel-combination of a gas discharge lamp means and a voltage-clamping sub-circuit; the voltage-clamping sub-circuit comprising a rectifier sub-assembly connected in circuit with the DC terminals; the final load being operative to absorb output power from the output terminals; the output power being absorbed by: (i) the gas discharge lamp means whenever it is in fact connected and functional, or (ii) the voltage-clamping subcircuit whenever the gas discharge lamp means is effectively non-connected.

2. The combination of claim 1 wherein the inverter circuit comprises control circuitry operative to effect control of the amount of power delivered to the final load from the inverter output irrespective of the magnitude of the DC voltage.

3. The combination of claim 1 wherein the inverter circuit comprises control circuitry operative to effect control of the effective magnitude of the inverter output voltage irrespective of the magnitude of the DC voltage.

4. An arrangement comprising:

a source operative to provide a DC voltage across a pair of DC terminals;

an inverter circuit connected with the DC terminals and operative to provide an alternating inverter output voltage at a pair of inverter output terminals; a tank-inductor and a tank-capacitor being series-connected across the inverter output terminals, thereby to form a series-tuned LC circuit; the series-tuned LC circuit having a natural resonance at or near the fundamental frequency of the inverter output voltage; a ballast output voltage being present across the tank-capacitor's terminals; and a load circuit connected with the tank-capacitor's terminals; the load circuit being characterized by:

(a) including a gas discharge lamp sub-assembly effectively parallel-connected across the tank-capacitor;

(b) including a transformer having a first winding effectively parallel-connected across the tank-capacitor and a second winding connected with a voltage-clamping sub-circuit; and (c) being operative to absorb output power from the tank-capacitor's terminals; this output power being absorbed by (i) the gas discharge lamp sub-assembly whenever it is in fact connected and functional, or (ii) the voltage-clamping sub-circuit whenever the gas discharge lamp sub-assembly is effectively non-connected.

5. The arrangement of claim 4 wherein the load circuit is further characterized in that the second winding is connected with the DC terminals by way of a rectifier sub-assembly.

6. The arrangement of claim 4 wherein the load circuit is further characterized in that the voltage-clamping sub-circuit includes a rectifier sub-assembly connected with the DC terminals.

7. The arrangement of claim 4 wherein the transformer is further characterized in that the first winding and the second winding have one terminal in common; the common terminal being connected with one of the DC terminals.

8. The arrangement of claim 4 wherein the load circuit is further characterized in that, whenever the gas discharge lamp sub-assembly is effectively non-connected, output power from the tank-capacitor's terminals is, via the voltage-clamping sub-circuit, rectified and supplied to the DC terminals.

9. The arrangement of claim 4 wherein the inverter circuit is further characterized in that: (i) the alternating inverter output voltage has a waveshape approximating that of a squarewave voltage; and (ii) whenever the gas discharge lamp sub-assembly is in fact connected and functional, the ballast output voltage has a waveshape approximating that of sinusoidal voltage.

10. An arrangement comprising:

a source operative to provide a DC voltage across a pair of DC terminals;

an inverter circuit connected with the DC terminals and operative to provide an alternating inverter output voltage at a pair of inverter output terminals; a tank-inductor and a tank-capacitor being series-connected across the inverter output terminals, thereby to form a series-tuned LC circuit; the series-tuned LC circuit having a natural resonance at or near the fundamental frequency of the inverter output voltage; a ballast output voltage being present across the tank-capacitor's terminals; and a load circuit connected with the tank-capacitor's terminals; the load circuit being characterized by:

(a) including a gas discharge lamp sub-assembly effectively parallel-connected across the tank-capacitor;

(b) including a transformer having a first winding effectively parallel-connected across the tank-capacitor and a second winding connected with the DC terminals by way of a rectifier sub-assembly;

(c) being operative to absorb output power from the tank-capacitor's terminals; this output power being absorbed by (i) the gas discharge lamp sub-assembly whenever it is in fact connected and functional, or (ii) the DC terminals whenever the gas discharge lamp sub-assembly is effectively non-connected.

11. The arrangement of claim 10 wherein the transformer is additionally characterized in that the first winding and the second winding have one terminal in common; which common terminal is connected with one of the DC terminals.

12. The arrangement of claim 10 wherein the transformer is additionally characterized in that the first winding and the second winding in combination are represented by a single winding with a tap; the tap being connected with one of the DC terminals by way of the rectifier sub-assembly.

13. A combination comprising:

a source of AC power line voltage;

a rectifier circuit assembly connected with the AC power line voltage and operative to provide a DC voltage between a B− bus and a B+ bus; the instantaneous absolute magnitude of the DC voltage being: (i) substantially equal to that of the AC power line voltage whenever the instantaneous absolute magnitude of the AC power line voltage is higher than about half its peak absolute magnitude; and (ii) approximately constant whenever the instantaneous absolute magnitude of the AC power line voltage is lower than about half its peak absolute magnitude; the rectifier circuit being further characterized by including a first and a second capacitor, each having a pair of terminals; a substantially constant DC voltage existing between each pair of terminals; the absolute magnitude of this constant DC voltage being no larger than half the peak absolute magnitude of the AC power line voltage; one of the terminals of the first capacitor being directly connected with the B− bus; one of the terminals of the second capacitor being directly connected with the B+ bus; and an inverter circuit assembly connected between the B− bus and the B+ bus; the inverter circuit assembly being operative to provide an inverter output voltage at a set of inverter output terminals; connected with the inverter output terminals is an LC circuit with a tank capacitor and a tank inductor; the LC circuit being resonant at or near the fundamental frequency of the inverter output voltage; a gas discharge lamp being connected in circuit with the inverter output terminals.

* * * * *